US005082758A

United States Patent [19]

Hoffend et al.

[11] Patent Number: 5,082,758

[45] Date of Patent: Jan. 21, 1992

[54] TONER AND DEVELOPER COMPOSITIONS WITH CHARGE ENHANCING ADDITIVES

[75] Inventors: Thomas R. Hoffend, Webster; Michelle M. Bruzee, Rochester; Clifford O. Eddy, Webster, all of N.Y.

[73] Assignee: Xerox Corporation, Stamford, Conn.

[21] Appl. No.: 575,691

[22] Filed: Aug. 31, 1990

[51] Int. Cl.[5] ..... G03G 9/097

[52] U.S. Cl. ..... 430/110; 430/106.6; 430/126

[58] Field of Search ..... 430/110, 106.6, 126, 430/107, 109

[56] References Cited

U.S. PATENT DOCUMENTS

| | | | |
|---|---|---|---|
| 3,893,935 | 7/1975 | Jadwin et al. | 252/62.1 |
| 4,221,856 | 9/1980 | Lu | 430/110 |
| 4,291,111 | 9/1981 | Lu | 430/107 |
| 4,291,112 | 9/1981 | Lu | 430/110 |
| 4,312,933 | 1/1982 | Lu | 430/122 |
| 4,556,624 | 12/1985 | Gruber et al. | 430/110 |
| 4,560,635 | 12/1985 | Hoffend et al. | 430/106.6 |
| 4,562,135 | 12/1985 | Winnik et al. | 439/106 |
| 4,604,338 | 8/1986 | Gruber et al. | 430/106 |
| 4,792,513 | 12/1988 | Gruber et al. | 430/110 |
| 4,937,157 | 6/1990 | Haack et al. | 430/110 |

*Primary Examiner*—John Goodrow
*Attorney, Agent, or Firm*—E. O. Palazzo

[57] ABSTRACT

A toner composition comprised of resin particles, pigment particles, and a tertiary amine hydrogen ammonium triflate charge enhancing additive.

34 Claims, No Drawings

TONER AND DEVELOPER COMPOSITIONS WITH CHARGE ENHANCING ADDITIVES

BACKGROUND OF THE INVENTION

This invention is generally directed to toner and developer compositions, and more specifically, the present invention is directed to developer and toner compositions containing charge enhancing additives, which impart or assist in imparting a positive charge to the toner resin particles and enable toners with rapid admix characteristics. In one embodiment, there are provided in accordance with the present invention toner compositions comprised of resin particles, pigment particles, and teriary amine hydrogen ammoniumtriflate salts, including stearyl dimethyl hydrogen ammonium triflate charge enhancing additives, which additives can, it is believed, enable, for example, toners with rapid admix of less than about 60 seconds in some embodiments, substantially stable electrical properties, it is believed, and the like. The aforementioned toner compositions usually contain pigment particles comprised of, for example, carbon black, magnetites, or mixtures thereof, cyan, magenta, yellow, blue, green, red, or brown components, or mixtures thereof, thereby providing for the development and generation of black and/or colored images. The toner compositions of the present invention can possess excellent admix characteristics as indicated herein, and can, it is believed, in embodiments maintain their triboelectric charging characteristics for an extended number of imaging cycles exceeding, for example, 50,000 in some embodiments. The toner and developer compositions of the present invention can be selected for electrophotographic, especially xerographic, imaging and printing processes, including color processes.

Developer compositions with charge enhancing additives, which impart a positive charge to the toner resin, are known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like. U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

In a patentability search report the following U.S. patents were reported: U.S. Pat. No. 4,562,135 which discloses dry positively charged colored toners with charge control agents of the formula X-A-C wherein X is a chromophore, A is a linking group and C is a triboelectric charge establishing group, see the Abstract and note column 4 wherein examples of C are provided; U.S. Pat. No. 4,556,624, which discloses toners with, for example, tetrafluoroborate charge additives, see for example column 4; and as background interest U.S. Pat. Nos. 4,560,635; 4,604,338 and 4,792,513.

There are illustrated in U.S. Pat. No. 4,338,390, the disclosure of which is totally incorporated herein by reference, developer compositions containing as charge enhancing additives organic sulfate and sulfonates, which additives can impart a positive charge to the toner composition. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014 and 4,394,430.

The following representative prior art, all U.S. patents, is also mentioned: U.S. Pat. No. 4,812,381 relating to toners and developers with quaternary ammonium salts of the formula illustrated in column 3, the preparation thereof, see column 4, and also note the working Examples, see columns 7 and 8, wherein specific charge additives are reported; U.S. Pat. No. 4,675,118 which discloses certain quaternary salts as fabric softeners, see the Abstract of the Disclosure, and note column 1, for example, wherein X is as recited including $OSO_3CH_3$ and halide; U.S. Pat. No. 4,752,550, the disclosure of which is totally incorporated herein by reference, directed to toners and developers with inner salts and mixtures thereof as charge additives, see for example column 4; U.S. Pat. No. reissue 32,883 (a reissue of U.S. Pat. No. 4,338,390), the disclosures of which are totally incorporated herein by reference, wherein toners with organic sulfonate and organic sulfate charge enhancing additives are illustrated, see columns 3, 4, and 5 to 10 for example; and U.S. Pat. No. 4,058,585 which discloses a process of extracting metals with organic solvent solutions of the salts of hydrogen ionic exchange agents, and quaternary ammonium compounds including bisulfates.

Processes for preparing quaternary ammonium salts by an ion exchange, or ion pair extraction method with soluble quaternary compounds is known, reference for example *Phase Transfer Catalysis, Principles and Techniques*, Academic Press, N.Y., 1978, especially page 76, C. M. Starks and C. Liotta, the disclosure of this textbook being totally incorporated herein by reference, and "Preparative Ion Pair Extraction", *Apotekarsocieteten/Hassle, Lakemidel*, pages 139 to 148, Sweden, 1974, the disclosure of which is totally incorporated herein by reference, which illustrates the preparation of certain bisulfates with water soluble ammonium salt reactants and a two-phase method wherein the product resides in the water phase.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040 there are illustrated toner compositions with chromium and cobalt complexes of azo dyes as negative charge enhancing additives.

In Japanese Publication No. 54-145542 there is illustrated a negatively chargeable toner consisting of a resin, a colorant, and the charge control agent pyridoxine aliphatic acid ester; East German Patent Publication 218697 relates to liquid developers with charge control additives with structural units of Formulas (I), (II) and (III), and which contain olefinically polymerizable bonds; U.S. Pat. No. 3,850,642 relates to multilayer sensitive elements with ionizable salts, acids, esters, and surfactants as charge control agents; U.S. Pat. No. 2,970,802 illustrates a composition for the control of hypercholestermia, which composition consists of a nontoxic gelatin containing aluminum nicotinate; and U.S. Pat. No. 3,072,659 discloses a method of preparing aluminum salts of nicotinic acid.

Illustrated in U.S. Pat. No. 4,937,157, the disclosure of which is totally incorporated herein by reference, are toner compositions comprised of resin, pigment, or dye, and tetraalkyl, wherein alkyl, for example, contains from 1 to about 30 carbon atoms, ammonium bisulfate charge enhancing additives such as distearyl dimethyl ammonium bisulfate, tetramethyl ammonium bisulfate, tetraethyl ammonium bisulfate, tetrabutyl ammonium bisulfate, and preferably dimethyl dialkyl ammonium bisulfate compounds where the dialkyl radicals contain from about 10 to about 30 carbon atoms, and more preferably dialkyl radicals with from about 14 to about 22 carbon atoms, and the like. The aforementioned charge additives can be incorporated into the toner or may be present on the toner surface. Advantages of rapid admix, appropriate triboelectric characteristics, and the like are achieved with many of the aforementioned toners. Toners with charge additives are disclosed in the patents in copending applications recited in the aforementioned patent.

In copending application U.S. Ser. No. 547,001, the disclosure of which is totally incorporated herein by reference, titled Toner And Developer Compositions With Charge Enhancing Additives, with the listed inventor John L. Haack, there are illustrated, for example, toners with quaternary ammonium hydrogen bisulfate, or tetraalkyl ammonium sulfonate charge additives. One additive is of the formula $R'_2R''_2N^+X^-$ wherein R' is alkyl with from 1 to about 25 carbon atoms, R'' is alkyl with from about 1 to about 8 carbon atoms, and X is an anion derived from a sulfonic acid. In the aforementioned copending application there are included reference to U.S. patents and copending applications that disclose toners with charge enhancing additives.

Although many charge enhancing additives are known, there continues to be a need for toners with additives, which toners can possess many of the advantages illustrated herein. Additionally, there is a need for positive charge enhancing additives which are useful for incorporation into black, and/or colored toner compositions. Moreover, there is a need for colored toner compositions containing certain charge enhancing additives. There is also a need for toner compositions with certain charge enhancing additives, which toners possess, it is believed, substantially acceptable stable triboelectric charging characteristics, and excellent admixing properties, especially for the addition of replenishment toner. Moreover, there continues to be a need for positively charged toner and developer compositions. Further, there is a need for toners with certain charge enhancing additives which can be easily and permanently dispersed into toner resin particles. There also is a need for positively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. Nos. 4,265,990 and 4,921,773, the disclosures of which are totally incorporated herein by reference. Also, there is a need for toner compositions which have the desired triboelectric charge level, for example, from about 10 to about 40 microcoulombs per gram, and preferably from about 10 to about 20 microcoulombs per gram, and in embodiments admix charging rates of from about 15 to about 60 seconds, and preferably from about 15 to about 30, as determined by the known charge spectrograph, reference for example U.S. Pat. No. 4,375,673, the disclosure of which is totally incorporated herein by reference. There is also a need for charge enhancing additives that have acceptable thermal stability and that will not decompose during toner processing at elevated temperatures.

SUMMARY OF THE INVENTION

It is a feature of the present invention to provide toner and developer compositions with charge enhancing additives.

In another feature of the present invention there are provided positively charged toner compositions useful for the development of electrostatic latent images including color images.

In yet another object of the present invention there are provided positively charged toner compositions containing tertiary amine hydrogen ammonium triflate salt charge enhancing additives.

In another feature of the present invention there are provided developer compositions with positively charged toner particles, carrier particles, and tertiary amine hydrogen ammonium triflate salt charge enhancing additives.

It is yet another feature of the present invention to provide toner particles for use in developer compositions, which particles have improved humidity sensitivity.

In yet another feature of the present invention there can be provided, it is believed, humidity insensitive, from about, for example, 20 to 80 percent relative humidity at temperatures of from 60° to 80° F. as determined in a relative humidity testing chamber, positively charged toner compositions with desirable admix properties of from about 15 seconds to about 60 seconds as determined by the charge spectrograph, and acceptable triboelectric charging characteristics of from about 10 to about 40 microcoulombs per gram.

Additionally, in a further feature of the present invention there are provided positively charged magnetic toner compositions, and positively charged colored toner compositions containing therein, or thereon tertiary amine hydrogen ammonium triflate charge additives.

Furthermore, in yet another feature of the present invention there are provided toner and developer compositions with tertiary amine hydrogen ammonium triflate salts of the formula $R_1R_2R_3N^-H^+$ $CF_3SO_3^-$ charge additives, wherein $R_1$, $R_2$ and $R_3$ are independently selected from the group consisting of alkyl or substituted alkyl groups, including alicyclic groups, and aryl or substituted aryl groups, which compositions are useful in a variety of electrostatic imaging and printing processes, including color xerography, and wherein the admix charging times, or rates for substantially uncharged replenished toner can be less than 60 seconds. In an embodiment of the present invention, $R_1$ and $R_2$ are methyl and $R_3$ is stearyl($C_{18}H_{37}$).

Another feature of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

Another feature of the present invention resides in the thermal stability permitting toner processing temperatures in excess of 200° C. for several minutes.

In an embodiment of the present invention there are provided toner compositions comprised of resin particles, pigment particles, and tertiary amine hydrogen ammonium triflate salts as charge enhancing additives. The present invention in an embodiment is directed to toner compositions comprised of resin, pigment, or dye, and tertiary amine hydrogen ammonium triflate salts of the formula $R_1R_2R_3N^-H^+$ $CF_3SO_3^-$wherein $R_1$, $R_2$ and $R_3$ are independently selected from the group consisting of alkyl, substituted alkyl, including alicyclic, aryl and substituted aryl groups; and the like. In an embodiment of the present invention, $R_1$ and $R_2$ are methyl and $R_3$ is stearyl ($C_{18}H_{37}$).

Illustrative examples of alkyl groups for $R_1$, $R_2$ and $R_3$ include those containing from about 1 to about 25 carbon atoms such as methyl, ethyl, propyl, butyl, pentyl, hexyl, octyl, nonyl, decyl, myristyl, cetyl, oleyl, pentadecyl, heptadecyl, stearyl, cyclohexyl, cosyl, the isomers thereof, and the like. Preferred alkyl groups for $R_1$ and $R_2$ in embodiments of the present invention include methyl, ethyl, propyl, butyl, and pentyl, while preferred alkyl groups for $R_3$ in embodiments of the present invention include those containing from about 8 carbon atoms to about 25 carbon atoms such as cetyl and stearyl.

Illustrative examples of aryl groups for $R_1$, $R_2$ and $R_3$ include those containing from about 6 to about 24 carbon atoms such as phenyl, naphthyl, tolyl, benzyl, phenethyl, anthryl, and the like, with phenyl being preferred in embodiments of the present invention.

The aforementioned charge additives can be incorporated into the toner or may be present on the toner surface in effective amounts. Advantages of rapid admix, appropriate triboelectric characteristics, and the like can be achieved with a number of the toners of the present invention.

Specific examples of charge control additives selected for the toners of the present invention include octyl dimethyl hydrogen ammonium triflate, cetyl dimethyl hydrogen ammonium triflate, stearyl dimethyl hydrogen ammonium triflate, stearyl diethyl hydrogen ammonium triflate, cyclohexyl dimethyl hydrogen ammonium triflate, distearyl methyl hydrogen ammonium triflate, phenyl dimethyl hydrogen ammonium triflate, tolyl dimethyl hydrogen ammonium triflate, benzyl dimethyl hydrogen ammonium triflate, and the like.

The charge control additives of the present invention, which can be present in the toner in various effective amounts, such as for example from about 0.05 to about 20, and from about 0.1 to about 5 weight percent in embodiments may be prepared by the reaction of trifluoromethane sulfonic acid, the anhydride thereof, or the ester thereof with an amine, such as a tertiary amine.

The preparation of the tertiary amine hydrogen ammonium salt charge additives is illustrated by the following reaction scheme wherein the substituents such as R are as illustrated herein:

REACTION SCHEME

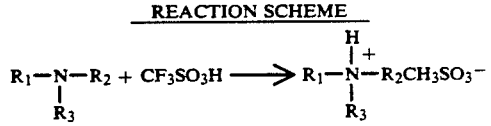

In one process embodiment, trifluoromethane sulfonic acid is diluted with equal parts of water for the primary purpose of eliminating fuming. An appropriate amine can then be dissolved in an alcohol, such as reagent grade isopropanol, about 100 milliliters, or other effective amount, with stirring and with heating, for example, at an effective temperature of about 60° C. in an embodiment. Once dissolved, the acid solution is added dropwise while heating and stirring to prevent the formation of crystals. The reaction mixture is then cooled to room temperature, and the resulting precipitate is filtered, whereby there is retained both the precipitate and the filtrate (liquor). The filtrate can then be chilled to, for example, less than 5° C., and thereafter filtered. The aforementioned crystals can be collected and dissolved with heating in an alcohol, such as isopropanol, about, for example, 100 milliliters, followed by further chilling and filtration. Thereafter, the crystal filtrate product resulting can be rinsed with, for example, a cold, less than 5° C., alcohol, such as isopropanol, followed by drying. The resulting products can be identified by a number of techniques including melting point, differential scanning calorimetry, infrared spectra, carbon, and proton nuclear magnetic resonance, ion chromotography, elemental analysis, and the like.

The toner compositions of the present invention can be prepared by a number of known methods, such as admixing and heating resin particles such as styrene butadiene copolymers, pigment particles, such as magnetite, carbon black, or mixtures thereof, and from about 0.05 percent to about 20 percent, and preferably from about 0.1 to about 5 weight percent of the aforementioned charge enhancing additives in a roll mill, an intensive internal mixer, such as a Banbury mixer, or in a toner extrusion device, such as the ZSK53 extruder available from Werner Pfleiderer, and removing the formed toner composition from the device. Subsequent to cooling, the toner composition is subjected to grinding or micronization utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified if desired utilizing, for example, a Donaldson Model B classifier for the purpose of removing fines, that is toner particles less than about 4 microns volume median diameter.

Illustrative examples of suitable toner resins selected for the toner and developer compositions of the present invention include styrene acrylate copolymers, styrene methacrylate copolymers, styrene butadiene copolymers, polyamides, polyolefins, epoxies, polyurethanes, vinyl resins, including homopolymers or copolymers of two or more vinyl monomers; and polymeric esterification products of a dicarboxylic acid and a diol including those comprising a diphenol. Vinyl monomers include styrene, p-chlorostyrene, unsaturated mono-olefins such as ethylene, propylene, butylene, isobutylene and the like; vinyl esters such as vinyl acetate, vinyl propionate, and vinyl butyrate; alkyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; diene monomers such as butadiene and isoprene; and mixtures thereof. Also, crosslinked resins including crosslinked styrene methacrylates, or styrene acrylates, wherein the crosslinking component is preferably divinylbenzene, and the like, reference the U.S. patents mentioned herein, the disclosures of which have been totally incorporated herein by reference, can be selected as the toner resin.

As one toner resin, there can be selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, styrene/acrylate copolymers, and styrene/butadiene copolymers; Pliolites ®; Pliotones ®, suspension polymerized styrene butadienes, reference U.S. Pat. No. 4,558,108, the disclosure of which is totally incorporated herein by reference; emulsion polymerized styrene butadienes, reference U.S. Pat. No. 4,469,770, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethyl terephthalate, 1,3-butanediol, 1,2-propanediol, and pentaerythritol, and mixtures thereof. Also, waxes with, for example, a molecular weight of from about 1,000 to about 20,000 such as polyethylene, polypropylene, and paraffin waxes can be included in or on the toner compositions, in effective amounts of, for example, from about 0.1 to about 5 weight percent, primarily as fuser roll release agents.

The toner resin can be present in a sufficient, but effective amount, for example from about 70 to about 95 weight percent. Thus, when 1 percent by weight of the charge enhancing additive is present, and 10 percent by weight of pigment or colorant, such as carbon black, is contained therein, about 89 percent by weight of toner resin is selected. Also, the charge enhancing additive of the present invention may be coated on the pigment particles. When used as a coating, the charge enhancing additive of the present invention can be present in an amount of from about 0.1 weight percent to about 5 weight percent, and preferably from about 0.3 weight percent to about 1 weight percent. When the charge enhancing additive of the present invention is not used as a coating, it can be present in embodiments of the present invention in an amount of from about 0.1 to about 5 weight percent, and preferably from about 0.1 weight percent to about 3 weight percent.

Numerous well known suitable pigments or dyes can be selected as the colorant for the toner particles including, for example, carbon black, such as those available from Cabot Corporation like Regal 330®, nigrosine dye, aniline blue, magnetite, or mixtures thereof. The pigment, which is preferably carbon black, should be present in a sufficient amount to render the toner composition highly colored. Generally, the pigment particles are present in effective amounts of, for example, from about 1 percent by weight to about 20 percent by weight, and preferably from about 2 to about 10 weight percent based on the total weight of the toner composition; however, lesser or greater amounts of pigment particles may be selected.

When the pigment particles are comprised of magnetites, thereby enabling, for example, single component toners in some instances, which magnetites are a mixture of iron oxides ($FeO.Fe_2O_3$) including those commercially available as Mapico Black, they are present, for example, in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as Mapico Black, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas such as Aerosil, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Some of the aforementioned additives are illustrated in U.S. Pat. No. 3,590,000 and 3,800,588, the disclosures of which are totally incorporated herein by reference.

With further respect to the present invention, colloidal silicas such as Aerosil can be surface treated with the charge additives of the present invention illustrated herein in an amount of from about 1 to about 30 weight percent and preferably about 10 weight percent, followed by the addition thereof to the toner in an amount of from about 0.1 to about 10 and preferably about 0.1 to about 1 weight percent.

There can be included in the toner compositions of the present invention low molecular weight waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide," and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention can be selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing resins which charge negatively, such as polystyrene, homopolymers, copolymers and terpolymers of halogen containing ethylenes including vinyl fluorides, vinylidene fluorides, vinyl chlorides, vinylidene chlorides, chlorotrifluoroethylene, and the like, illustrative examples of which include a vinyl chloride/chlorotrifluoroethylene copolymer, a vinyl chloride/vinyl acetate copolymer, a chlorotrifluoroethylene polymer and various known vinyl chloride terpolymers. Many of the typical carriers that can be used are described in U.S. Pat. Nos. 2,618,441; 2,638,522; 3,533,835; 3,526,533 and 3,467,634, the disclosures of which are totally incorporated herein by reference, other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series may, it is believed, also be selected, reference U.S. Pat. Nos. 4,937,166 and 4,935,326, the disclosure of which are totally incorporated herein by reference, including for example Kynar and polymethylmethacrylate mixtures (40/60). Coating weights can vary as indicated herein; generally, however, from about 0.1 to about 5, and preferably from about 0.5 to about 3 weight percent coating weight is selected.

Furthermore, the diameter of the carrier particles, spherical in shape in some embodiments, is generally from about 50 microns to about 1,000 microns thereby permitting them to possess sufficient density and inertia to avoid adherence to the electrostatic images during the development process. The carrier component can be mixed with the toner composition in various suitable combinations, however, in embodiments from about 1 to 5 parts per toner to about 10 parts to about 200 parts by weight of carrier can be selected.

The toner composition of the present invention can be prepared by a number of known methods as indicated herein, including Banbury/roll mill processing the toner resin particles, pigment particles or colorants, and the charge enhancing additive of the present invention as indicated herein, followed by mechanical attrition. Other methods include those well known in the art such as spray drying, melt dispersion, extrusion processing, dispersion polymerization, and suspension polymerization. Also, as indicated herein the toner composition without the charge enhancing additive can be prepared, followed by the addition of colloidal silicas surface treated with the charge additives.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. Nos. 4,265,990 and 4,921,773, the disclosures of which are totally incorporated herein by reference. Illustrative examples of inorganic photoconductors that may be selected for imaging and printing processes include selenium; selenium alloys, such as selenium arsenic, selenium tellurium and the like; halogen doped selenium substances; and halogen doped selenium alloys.

The micronization of the toner can include known jetting and classification as indicated herein to enable toner particles with a preferred average diameter of from about 5 to about 25 microns, and in embodiments from about 6 to about 12 microns. The toner compositions in embodiments of the present invention posess a triboelectric charge of from about 0.1 to about 2 femtocoulombs per micron as determined by the known charge spectograph. Admix times for replenishment of substantially uncharged toner can be in embodiments of the present invention from about 15 seconds to 1 minute, and more specifically from about 15 to about 30 seconds as determined by the known charge spectograph. The toner compositions with rapid admix characteristics enable, for example, the development of images in electrophotographic imaging apparatuses, which images have substantially no background deposits thereon, even at high toner dispensing rates in some instances, for instance exceeding 15 grams per minute; and further, such toner compositions can be selected for high speed electrophotographic apparatuses, that is those exceeding 70 copies per minute. With further respect to the present invention, one developer composition is comprised of a toner composition containing the tertiary amine hydrogen ammonium salt charge enhancing additive as illustrated herein, pigment particles such as carbon black, resin particles, and carrier particles comprised of a core containing thereover a polymeric coating.

Also, the toner compositions of the present invention can possess desirable narrow charge distributions, optimal charging triboelectric values of from 10 to about 40, and in embodiments from about 10 to about 35 microcoulombs per gram with from about 0.1 to about 5 weight percent of the charge enhancing additive; and rapid admix charging times as determined in the charge spectrograph of less than 60 seconds, and preferably in some embodiments from about 15 to about 30 seconds.

The following examples are being supplied to further define various species of the present invention, it being noted that these examples are intended to illustrate and not limit the scope of the present invention. Parts and percentages are by weight unless otherwise indicated. Also included is a comparative Example.

EXAMPLE I

Synthesis of Stearyl Dimethyl Hydrogen Ammonium Triflate

The selected acid reactant was first stabilized as follows: 50.0 mls (milliliters) of trifluoromethanesulfonic acid (available from 3M as FC24) was slowly added with stirring to 50.0 milliliters of distilled water (the aforementioned strong acid fumes profusely).

64.20 gms (grams) of stearyldimethylamine were dissolved in 100 milliliters reagent grade of isopropanol and heated to 60° C. with stirring in a 1 liter reaction vessel with 4 necks. A water cooled condenser was placed on one of the necks. A dropping funnel was placed on another neck.

72.03 grams of the above prepared aqueous acid solution were placed in the dropping funnel. The acid solution was added dropwise to the reaction vessel in a manner that no crystals formed before all the reagents were added. The reaction vessel was then allowed to reach room temperature.

Crystals formed were filtered from the reaction mixture, collected, and redissolved in a minimal amount of reagent grade isopropanol. The resulting liquid mixture was cooled and filtered. The filtrate was washed with two 50 milliliter portions of chilled isopropanol to provide the above desired product. The percent theoretical yield was about 80. The molecular weight of the product was 418 grams/mole, and the melting point of the recrystallized material was 80° to 83° C. The elemental analysis of the product agreed well with theoretical as follows:

Theoretical: $C_{21}H_{44}NSO_3F_3$: C, 56.38; H, 9.84; N, 3.13; S, 7.16; O, 10.74; F, 12.75. Found: C, 56.35; H, 9.19; N, 2.96; S, 7.56; O, 11.98; F, 12.04; Water, 0.30 weight percent

EXAMPLE II

There was prepared by a Banbury/roll mill process, a toner composition by melt blending together 80 percent by weight of suspension polymerized styrene butadiene copolymer resin particles (87/13 styrene/butadiene), reference U.S. Pat. No. 4,558,108, the disclosure of which is totally incorporated herein by reference; 16.0 percent by weight of the magnetite Mapico Black; and 4.0 percent by weight of Regal 330® carbon black. The resulting toner was subjected to grinding in a Sturtevant micronizer enabling particles with a volume median diameter of about 9 microns as measured by a Coulter Counter. Thereafter, the aforementioned toner particles were classified in an MZR 100 classifier for the purpose of removing fine particles, that is those with a volume median diameter of less than 4 microns.

Subsequently, the above formulated toner, 3 parts by weight, was mixed with 97 parts by weight of a carrier comprised of a steel core with a polymer coating thereof, 1.25 percent by weight, the polymer being FPC 461 resin with 35 weight percent of vinyl chloride/65 weight percent of chlorotrifluoroethylene composition containing 7.5 weight percent of Regal 330® carbon black and wherein mixing was accomplished in a paint shaker for 10 minutes. There resulted on the toner a negative charge of 30 microcoulombs per gram as determined by the known Faraday Cage method.

There was then added to the above prepared developer composition 1 part by weight of an uncharged toner comprised of 80 percent by weight of suspension polymerized styrene butadiene copolymer resin particles (87/13), reference U.S. Pat. No. 4,558,108, the disclosure of which is totally incorporated herein by reference; 16.0 percent by weight of the magnetite Mapico Black; and 4.0 percent by weight of Regal 330® carbon black. Thereafter, the charge distribution of the resulting developer was measured as a function of the mixing time, and it was determined by a charge spectrograph, reference for example U.S. Pat. No. 4,375,673, the disclosure of which is totally incorporated herein by reference, that the admixing time was greater than 60 seconds for the added uncharged toner.

EXAMPLE III

There was prepared by a Banbury/roll mill process, a toner composition by-melt blending together 79 percent by weight of suspension polymerized styrene butadiene copolymer resin particles (87/13 styrene/butadiene), reference U.S. Pat. No. 4,558,108, the disclosure of which is totally incorporated herein by reference; 16.0 percent by weight of the magnetite Mapico Black; 4.0 percent by weight of Regal 330® carbon black; and 1.0 percent by weight of the charge enhancing additive stearyl dimethyl hydrogen ammonium triflate obtained from Example I. The resulting toner was subjected to grinding in a Sturtevant micronizer enabling particles with a volume median diameter of from 9 microns as measured by a Coulter Counter. Thereafter, the aforementioned toner particles were classified in an MZR 100 classifier for the purpose of removing fine particles, that is those with a volume median diameter of less than 4 microns.

Subsequently, the above formulated toner, 3 parts by weight, was mixed with 97 parts by weight of a carrier comprised of a steel core with a polymer coating thereover, 1.25 percent by weight, the polymer being FPC 461 resin with 35 weight percent of vinyl chloride/65 weight percent of chlorotrifluoroethylene composition, wherein the coating contains 7.5 weight percent of Regal 330® carbon black, and wherein mixing was accomplished in a paint shaker for 10 minutes. There resulted on the toner a positive charge of 30 microcoulombs per gram as determined by the Faraday Cage method.

There was then added to the above prepared developer composition 1 part by weight of an uncharged toner comprised of 79 percent by weight of suspension polymerized styrene butadiene copolymer resin particles (87/13), reference U.S. Pat. No. 4,558,108, the disclosure of which is totally incorporated herein by reference; 16.0 percent by weight of the magnetite Mapico Black; 4.0 percent by weight of Regal 330® carbon black; and 1.0 percent by weight of the charge enhancing additive stearyl dimethyl hydrogen ammonium triflate obtained from Example I. Thereafter, the charge distribution of the resulting developer was measured as a function of the mixing time, and it was determined by a charge spectrograph that the admixing time was 30 seconds for the aforementioned added uncharged toner.

EXAMPLE IV

There was prepared by a Banbury/roll mill process a toner composition by melt blending together 77 percent by weight of suspension polymerized styrene butadiene copolymer resin particles (87/13 styrene/butadiene), reference U.S. Pat. No. 4,558,108, the disclosure of which is totally incorporated herein by reference; 16.0 percent by weight of the magnetite Mapico Black; 4.0 percent by weight of Regal 330® carbon black; and 3.0 percent by weight of the charge enhancing additive stearyl dimethyl hydrogen ammonium triflate obtained from Example I. The resulting toner was subjected to grinding in a Sturtevant micronizer enabling particles with a volume median diameter of from 9 microns as measured by a Coulter Counter. Thereafter, the aforementioned toner particles were classified in an MZR 100 classifier for the purpose of removing fine particles, that is those with a volume median diameter of less than 4 microns.

Subsequently, the above formulated toner, 3 parts by weight, was mixed with 97 parts by weight of a carrier comprised of a steel core with a polymer coating mixture thereof, 1.25 percent by weight, the polymer being FPC 461 resin, having a 35 weight percent of vinyl chloride/65 weight percent of chlorotrifluoroethylene composition, which coating had dispersed therein 7.5 weight percent of Regal 330® carbon black, and wherein mixing was accomplished in a paint shaker for 10 minutes. There resulted on the toner composition, as determined in the known Faraday Cage apparatus, a positive triboelectric charge of 30 microcoulombs per gram.

There was then added to the above prepared developer composition 1 part by weight of an uncharged toner comprised of 77 percent by weight of suspension polymerized styrene butadiene copolymer resin particles (87/13), reference U.S. Pat. No. 4,558,108, the disclosure of which is totally incorporated herein by reference; 16.0 percent by weight of the magnetite Mapico Black; 4.0 percent by weight of Regal 330® carbon black; and 3.0 percent by weight of the charge enhancing additive stearyl dimethyl hydrogen ammonium triflate obtained from Example I. Thereafter, the charge distribution of the resulting developer was measured as a function of the mixing time, and it was determined by a charge spectrograph that the admixing time was 15 seconds for the aforementioned added uncharged toner.

The tribo and admix results imparted to the developer by the stearyl dimethyl hydrogen ammonium triflate charge enhancing additive are summarized in Table 1.

TABLE 1

| Toner Composition from Example | Weight % Stearyl Dimethyl Ammonium Triflate in the Toner | Tribo μc./g. | Admix Time Seconds |
|---|---|---|---|
| II | 0 | Negative 30 | >60 |
| III | 1 | Positive 30 | 30 |
| IV | 3 | Positive 29 | 15 |

Other modifications of the present invention may occur to those skilled in the art subsequent to a review of the present application, and these modifications, including equivalents thereof, are intended to be included within the scope of the present invention.

What is claimed is:

1. A toner composition comprised of resin particles, pigment particles, and a tertiary amine hydrogen ammonium triflate charge enhancing additive.

2. A toner composition comprised of resin particles, pigment particles, and a tertiary amine hydrogen ammonium triflate charge enhancing additive substantially represented by the formula $R_1R_2R_3N^-H^+(CF_3SO_3)^-$, wherein $R_1$, $R_2$ and $R_3$ are independently selected from the group consisting of alkyl, substituted alkyl, alicyclic, aryl, and substituted aryl.

3. A toner composition in accordance with claim 2 wherein $R_1$, $R_2$, and $R_3$ are alkyl with from 1 to about 25 carbon atoms.

4. A toner composition in accordance with claim 2 wherein $R_1$ and $R_2$ are alkyl with from 1 to about 25 carbon atoms and $R_3$ is aryl with from 6 to about 24 carbon atoms.

5. A toner composition in accordance with claim 2 wherein $R_1$ is stearyl.

6. A toner composition in accordance with claim 2 wherein $R_3$ is phenyl.

7. A toner composition in accordance with claim 2 wherein the charge enhancing additive is selected from the group consisting of octyl dimethyl hydrogen ammonium triflate, cetyl dimethyl hydrogen ammonium triflate, stearyl dimethyl hydrogen ammonium triflate, stearyl diethyl hydrogen ammonium triflate, cyclohexyl dimethyl hydrogen ammonium triflate, distearyl methyl hydrogen ammonium triflate, phenyl dimethyl hydrogen ammonium triflate, tolyl dimethyl hydrogen ammonium triflate, and benzyl dimethyl hydrogen ammonium triflate.

8. A toner composition in accordance with claim 2 wherein the charge additive is present in an amount of from about 0.1 to about 10 weight percent.

9. A toner composition in accordance with claim 2 wherein the charge additive is present in an amount of from about 0.1 to about 3 weight percent.

10. A toner composition in accordance with claim 2 wherein the charge additive is incorporated into the toner.

11. A toner composition in accordance with claim 2 wherein the charge additive is present on the surface of the toner composition.

12. A toner composition in accordance with claim 11 wherein the charge additive is contained on colloidal silica particles.

13. A toner composition in accordance with claim 2 with an admix time of from less than about 60 seconds.

14. A toner composition in accordance with claim 2 with an admix time of from about 15 to about 60 seconds.

15. A toner composition in accordance with claim 2 with a triboelectric charge of from about 10 to about 40 microcoulombs per gram.

16. A toner composition in accordance with claim 2 wherein a colloidal silica is treated with the charge enhancing additive, and the resulting composition is present on the surface of the toner.

17. A toner composition in accordance with claim 2 wherein the resin particles are comprised of styrene copolymers, polyesters, or mixtures thereof.

18. A toner composition in accordance with claim 2 wherein the resin particles are comprised of styrene acrylate copolymers, styrene methacrylate copolymers, or styrene butadiene copolymers.

19. A toner composition in accordance with claim 2 containing a wax component with a weight average molecular weight of from about 1,000 to about 6,000.

20. A toner composition in accordance with claim 19 wherein the waxy component is selected from the group consisting of polyethylene and polypropylene.

21. A toner composition in accordance with claim 2 containing as external additives metal salts of a fatty acid, colloidal silicas, or mixtures thereof.

22. A toner composition in accordance with claim 2 wherein the pigment particles are carbon black, magnetites, or mixtures thereof, cyan, magenta, yellow, red, blue, green, brown, and mixtures thereof.

23. A developer composition comprised of the toner composition of claim 1 and carrier particles.

24. A developer composition comprised of the toner composition of claim 2 and carrier particles.

25. A developer composition in accordance with claim 23 wherein the carrier particles are comprised of ferrites, steel, or an iron powder.

26. A developer composition in accordance with claim 25 wherein the carrier particles are comprised of a core with a polymer coating thereover.

27. A developer composition in accordance with claim 26 wherein the coating is comprised of a vinyl chloride/chlorotrifluoroethylene copolymer, methyl terpolymer, a polyvinylidine fluoride, a polymethyl methacrylate, or a mixture of polymers not in close proximity in the triboelectric series.

28. A method of imaging which comprises formulating an electrostatic latent image on a photoreceptor, affecting development thereof with the toner composition of claim 1, and thereafter transferring the developed image to a suitable substrate.

29. A method of imaging in accordance with claim 28 wherein the transferred image is permanently fixed to the substrate.

30. A method of imaging which comprises formulating an electrostatic latent image on a negatively charged photoreceptor, affecting development thereof with the toner composition of claim 2, and thereafter transferring the developed image to a suitable substrate.

31. A method of imaging in accordance with claim 30 wherein the transferred image is permanently fixed to the substrate.

32. A single component positively charged toner composition comprised of resin particles, magnetite components, and a tertiary amine hydrogen ammonium triflate charge enhancing additive.

33. A positively charged toner composition comprised of resin, pigment, and a tertiary amine hydrogen ammonium triflate charge enhancing additive.

34. A positively charged toner composition comprised of resin particles, pigment, and a tertiary amine hydrogen ammonium triflate charge enhancing additive.

* * * * *